US011511173B2

(12) United States Patent
Gollub

(10) Patent No.: US 11,511,173 B2
(45) Date of Patent: Nov. 29, 2022

(54) GOLF SWING TRAINING DEVICE AND METHODS OF USING THE SAME

(71) Applicant: Matt Gollub, St. Louis, MO (US)

(72) Inventor: Matt Gollub, St. Louis, MO (US)

(73) Assignee: Matt Gollub, St. Louis, MO (US)

( * ) Notice: Subject to any disclaimer, the term of this patent is extended or adjusted under 35 U.S.C. 154(b) by 0 days.

(21) Appl. No.: 17/237,724

(22) Filed: Apr. 22, 2021

(65) Prior Publication Data

US 2021/0331056 A1 Oct. 28, 2021

Related U.S. Application Data

(60) Provisional application No. 63/014,451, filed on Apr. 23, 2020.

(51) Int. Cl.
*A63B 69/36* (2006.01)

(52) U.S. Cl.
CPC ..... *A63B 69/3667* (2013.01); *A63B 2214/00* (2020.08)

(58) Field of Classification Search
CPC . A63B 69/3667; A63B 2214/00; A63B 57/19; A63B 69/3623
USPC ..... 473/218, 257, 266, 268, 270, 278, 279, 473/409
See application file for complete search history.

(56) References Cited

U.S. PATENT DOCUMENTS

| | | | | | |
|---|---|---|---|---|---|
| 3,542,369 | A * | 11/1970 | Anderson | A63B 69/3661 | 473/257 |
| 5,108,106 | A * | 4/1992 | Cook | A63B 69/3667 | 473/272 |
| 5,910,053 | A * | 6/1999 | Scalise | A63B 69/3667 | 473/257 |
| 6,514,151 | B2 * | 2/2003 | Delaplane | A63B 57/10 | 473/268 |
| 6,949,029 | B1 * | 9/2005 | Strande | A63B 69/3623 | 473/218 |
| 7,850,536 | B1 * | 12/2010 | Fitzgerald | A63B 69/3676 | 473/220 |
| 2009/0176595 | A1 * | 7/2009 | Hubley | A63B 69/3623 | 473/238 |
| 2009/0215548 | A1 * | 8/2009 | Broering | A63B 69/3614 | 473/220 |
| 2010/0069168 | A1 * | 3/2010 | Rhodes | A63B 69/3667 | 473/218 |

* cited by examiner

*Primary Examiner* — Nini F Legesse
(74) *Attorney, Agent, or Firm* — Lewis Rice LLC

(57) ABSTRACT

Systems and methods for a golf training aid which is designed to orient the player initially to have a correct backswing of the club and then follow through with a fairly natural downswing to produce the desired ball flight characteristics. In an embodiment, there is provided a device that encourages a user to practice a golf swing having a sufficiently steep angle for the plane of the swing.

10 Claims, 4 Drawing Sheets

GOLF SWING TRAINING DEVICE AND METHODS OF USING THE SAME

CROSS REFERENCE TO RELATED APPLICATION(S)

This application claims the benefit of U.S. Provisional Patent Application Ser. No. 63/014,451, filed Apr. 23, 2020, the entire disclosure of which is herein incorporated by reference.

BACKGROUND OF THE INVENTION

Field of the Invention

This disclosure is related to the field of golf swing training devices and methods of using the same. More particularly, this disclosure is related to a physical mat or placard that may assist a golfer with following proper form during the backswing portion of the golfer's overall golf swing.

Description of the Related Art

Golf is a club-and-ball sport in which players use various clubs to hit balls into a series of holes (also known as ups) on a course in as few strokes as possible. Golf, unlike most ball games, cannot and does not utilize a standardized playing area, and coping with the varied terrains encountered on different courses is a key part of the game. The game at the usual level is played on a course with an arranged progression of 18 holes, though recreational courses can be smaller, often having only nine holes. Each hole on the course must contain a tee box to start from and a putting green containing the targeted hole or cup, which has a predetermined 4¼-inch diameter. There are other standard forms of terrain in between, such as the fairway, rough (long grass), bunkers (or "sand traps"), and various hazards (water, rocks), but each hole on a course is typically unique in its specific layout and arrangement.

Golf is typically played for the lowest number of strokes (each stroke being a swing of a single golf club at the golf ball being played) by an individual, known as stroke play, or the lowest score on the most individual holes in a complete round by an individual or team, known as match play. Stroke play is the most commonly seen format at all levels, but most especially at the elite level.

The golf swing is outwardly similar to many other motions involving swinging a tool or sporting implement, such as an axe or a baseball bat. However, unlike many of these motions, the result of the swing is highly dependent on several sub-motions being properly aligned and timed due to the shape of the club. These sub-motions ensure that the club travels up to the ball in line with the desired path; that the clubface is in line with the swing path; and that the ball hits the center or "sweet spot" of the clubface. The ability to do this consistently, across a complete set of golf clubs with a wide range of shaft lengths and clubface areas, is a key skill for any golfer, and takes a significant effort to achieve.

In order to propel the ball towards the hole, a golfer must choose a club to swing and a stroke to use with the club. There are a variety of both clubs (having different impact surfaces and angles of that surface relative to the direction of the club shaft) and strokes (having different characteristics typically related to the applied power of the swing). A golfer may choose a stroke between, for example, without limitation, a full swing, a three-quarters swing, a half-swing, and a putt. Each of the different clubs and swings may combine to produce a movement of the ball once struck that is different from other combination. For example, some clubs may create more loft or more ball spin, and some strokes may produce more distance or curvature of the flight path of the ball.

Having chosen a club and stroke to produce the desired distance (or other ball flight characteristics), the golfer typically addresses the ball by taking their stance to the side of it and (except when the ball lies in a hazard) grounding the club behind the ball. The golfer then typically takes their backswing, rotating the club, their arms, and their upper body away from the ball, and then begins their downswing, bringing the clubhead back down and around to hit the ball. Thus, a proper golf swing includes two parts: a backswing, wherein the golfer moves the clubhead upwards and backwards; and a downswing, wherein the golfer brings the clubhead back down and forward to connect with the ball. The golf swing may also be considered to include a third part, a follow through, which occurs after the ball is contacted with the clubhead as the clubhead continues forward movement (often directing the resulting flight of the ball) and is then brought upwards and curves around the golfer beginning in front of the golfer.

A proper golf swing is a complex combination of motions, and slight variations in posture or positioning can make a great deal of difference in how well the ball is hit and how straight it travels. The general goal of a golfer making a full swing is to propel the clubhead as fast as possible while maintaining a single "plane" of motion of the clubhead (at least during the downswing), to send the clubhead into the ball along the desired path of travel and with the clubhead also pointing in that direction.

Golf clubs are designed with the intention that, when swung at a ball, the clubface of the clubhead will contact the ball with the lengthwise edges of the clubhead oriented parallel to the ground and orthogonal to the intended direction of travel for the ball (the plane of the clubface need not be orthogonal to the intended direction of travel for the ball and typically is not orthogonal due to the loft of most golf clubs, other than a putter). This allows for the proper orientation of the clubface so that the ball will travel straight forward (and not at an angle to the left or right of the intended target) and without a yaw (which is a spin about the ball's vertical axis). Thus, the plane of motion of the clubhead (at least for the downswing) should be oriented such that the clubface will meet the ball at the required orientation described just above. Again, each part of the golf swing (backswing, downswing, and follow through) may contribute to the final orientation of the clubface while contacting the ball, and accordingly, each part of the golf swing may contribute to the flight of a struck ball.

Because the golf swing is a rather involved and complicated motion that requires consistency to produce consistent ball strikes, many golf swing training aids or devices exist, which aids or devices typically attempt to improve a golfer's swing characteristics through practicing with a proper form. For example, such a golf swing training aid is discussed in U.S. Pat. No. 4,915,387, the entire disclosure of which is hereby incorporated by reference in its entirety. This patent discloses a golf swing practice mat, upon which a golfer stands to practice their swing. The mat itself includes indicators for where the golfer should place their feet, as well as marks to indicate the proper downswing path for the golf club to strike a ball placed onto the mat. The mat even includes alternate positions for placement of the ball relative to the feet of the golfer, which alternate positions are intended to impart different flight characteristics to a struck ball. Generally, each of the swing indicators are related to the downswing and follow through parts of the golfer's swing. However, the mat does also assist the golfer in positioning themselves and their club/clubhead relative to the ball before the beginning of or during the backswing.

One issue not addressed by the above golf swing training aid disclosed in the above patent, as well as other known golf swing training aids, is the proper backswing positioning and motion. In particular, there is typically a relationship between the intended flight path of the ball and the backswing path for the golfer's clubhead. This may be because the backswing may affect the orientation of the clubhead during the downswing, as well as the loading of the golfer's muscles during the backswing that will be used to give energy to the subsequent downswing. Further, it is generally a difficult task to take a proper backswing because the process for taking a proper backswing is somewhat unintuitive.

Most people, when presented with a ball on a tee, will line themselves up with the ball such that the clubhead is positioned directly behind the ball, and that the path of the clubhead during the backswing will begin and stay over a line that travels through the ball and the intended target. This seems intuitive—it makes sense that one would want the clubhead to travel during the downswing directly through the line that travels through the ball and the intended target. However, such a backswing, in reality, typically leads to a situation wherein the plane of motion for the downswing is too shallow, which may lead to an undesired positioning of the clubface when contacting the ball during a swing. Instead, the golfer should maintain a relatively steep plane of movement for the clubhead, and the backswing should be made to travel back from the ball at an angle away from the golfer.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein are systems and methods for a golf training aid which is designed to orient the player initially to have a correct backswing of the club and then follow through with a fairly natural downswing to produce the desired ball flight characteristics. In an embodiment, there is provided a device that encourages a user to practice a golf swing having a sufficiently steep angle for the plane of the swing.

There is described herein, among other things, a golf swing training device comprising: a generally planar body having a hole arranged therein; a first indicator shown on said body, said first indicator comprising a target line which does not intersect with said hole; and a second indicator shown on said body, said second indicator comprising a takeaway club path line which does not intersect with said hole; wherein said target line and said takeaway club path line have an angle between them of about 5 to about 15 degrees.

In an embodiment of the device, the body is generally pear-shaped.

In an embodiment of the device, the body includes two generally linear sides or generally equal length and two generally arcuate sides, a first of said two generally arcuate sides being longer than a second of said two generally arcuate sides.

In an embodiment of the device, the two generally arcuate sides are about 3 feet apart.

In an embodiment of the device, the two generally arcuate sides transcribe convex arcs.

In an embodiment of the device, the angle between said target line and said takeaway club path line is about 8 to about 12 degrees.

In an embodiment of the device, the angle between said target line and said takeaway club path line is about 9 to about 11 degrees.

In an embodiment of the device, the angle between said target line and said takeaway club path line is about 10 degrees.

In an embodiment, the device the further comprises a tee placed through said hole.

In an embodiment, the device the further comprises a ball placed on said tee.

There is also described herein, in an embodiment, a method for practicing a golf swing, the method comprising: providing a training device comprising: a generally planar body having a hole arranged therein; a first indicator shown on said body, said first indicator comprising a target line which does not intersect with said hole; and a second indicator shown on said body, said second indicator comprising a takeaway club path line which does not intersect with said hole; wherein said target line and said takeaway club path line have an angle between them of about 5 to about 15 degrees; placing a golf ball on a tee in said hole; moving a golf club through a backswing, said backswing directing said club generally along said takeaway club path line; and moving said golf club through a downswing, said downswing contacting said ball and projecting said ball along a path generally aligned with said target line.

In an embodiment of the method, the body is generally pear-shaped.

In an embodiment of the method, the body includes two generally linear sides or generally equal length and two generally arcuate sides, a first of said two generally arcuate sides being longer than a second of said two generally arcuate sides.

In an embodiment of the method, the two generally arcuate sides are about 3 feet apart.

In an embodiment of the method, the two generally arcuate sides transcribe convex arcs.

In an embodiment of the method, the angle between said target line and said takeaway club path line is about 8 to about 12 degrees.

In an embodiment of the method, the angle between said target line and said takeaway club path line is about 9 to about 11 degrees.

In an embodiment of the method, the angle between said target line and said takeaway club path line is about 10 degrees.

DETAILED DESCRIPTION OF PREFERRED EMBODIMENTS

The following detailed description and disclosure illustrates by way of example and not by way of limitation. This description will clearly enable one skilled in the art to make and use the disclosed systems and methods, and describes several embodiments, adaptations, variations, alternatives, and uses of the disclosed systems and methods. As various changes could be made in the above constructions without departing from the scope of the disclosures, it is intended that all matters contained in the description or shown in the accompanying drawings shall be interpreted as illustrative and not in a limiting sense.

Figure 1:
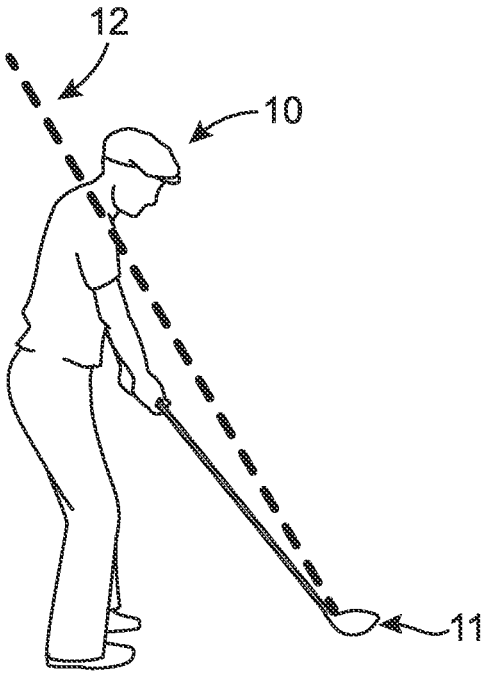
FIG. 1 depicts a good golf swing plane that is relatively steep.
Figure 2:
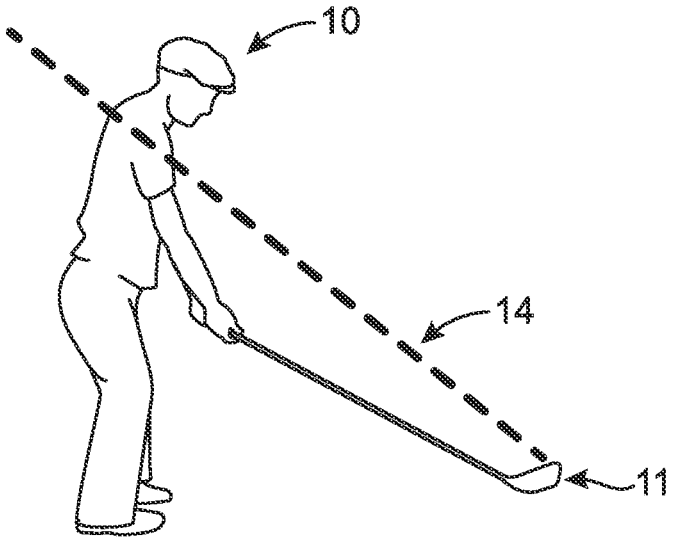
FIG. 2 depicts a golf swing plane that is relatively shallow.

FIGS. 1 and 2 depict golfers having two different body postures and resultant swing planes in order to illustrate how the plane of a backswing may be changed. FIG. 1 shows a hypothetical golfer (10) addressing a ball (11) and posturing their body such that the golfer's swing plane (12) will be formed at a relatively steep angle, which is generally the proper angle for a swinging plane to hit a ball straight. On the other hand, FIG. 2 shows a hypothetical golfer (10) addressing a ball and positioning their body such that their swing plane (14) will be formed at a relatively shallow angle, which is typically improper. These two different positions, and their related planes of movement (12, 14) to be made during a subsequent golf backswing, may affect how the ball is struck by the golf club and clubhead. Generally, a backswing that is too shallow (like the swing plane shown in FIG. 2) may unintentionally create a slice, or movement from left to right for a right-handed golfer, for the flight of the ball after the ball is impacted by the clubface.

Figure 3:
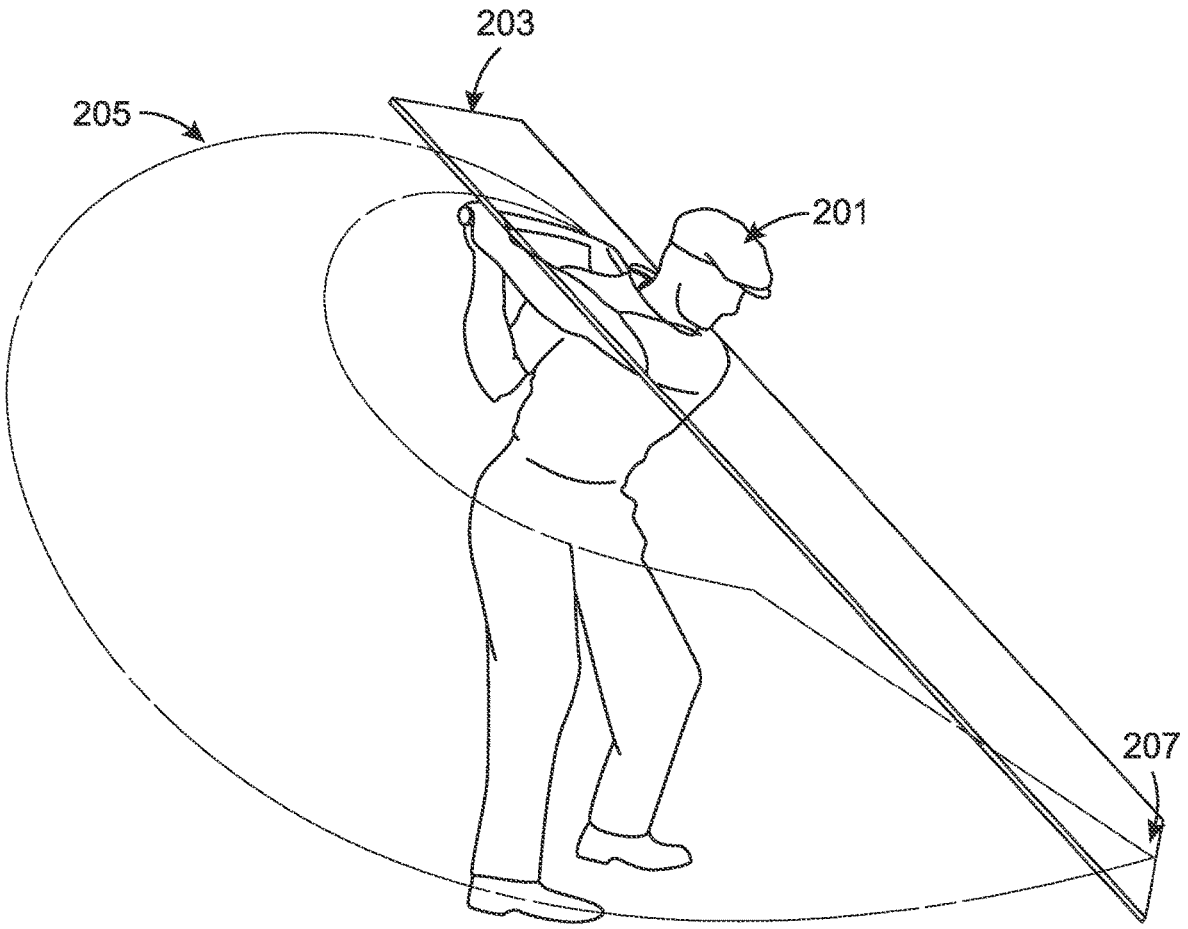
FIG. 3 depicts a golf swing which is at a good angle.

Additional detail on the plane of motion for a backswing and the resultant impact plane of the ball is depicted in FIG. 3. In FIG. 3, the golfer (201) is shown swinging a club to hit the ball along the illustrated plane (203). FIG. 3 also depicts the actual movement of the club (205) during the swing at a ball that is located at a point (207) near the bottom of the plane (203). Note that the club (205) being swung always stays immediately below the plane (203) and does not track the plane (203), if the plane (203) were to extend out along its two axes. Further, it may be seen in FIG. 3 that it may be important for the golfer (201) to have proper posture and positioning to allow the golfer (201) to move within the desired plane (203). The entire process of the swing (backswing and downswing) may affect how the club (205) moves during the swing, and accordingly, it is important for the golfer to have proper posture and positioning during the entire swing.

Figures 1, 4:
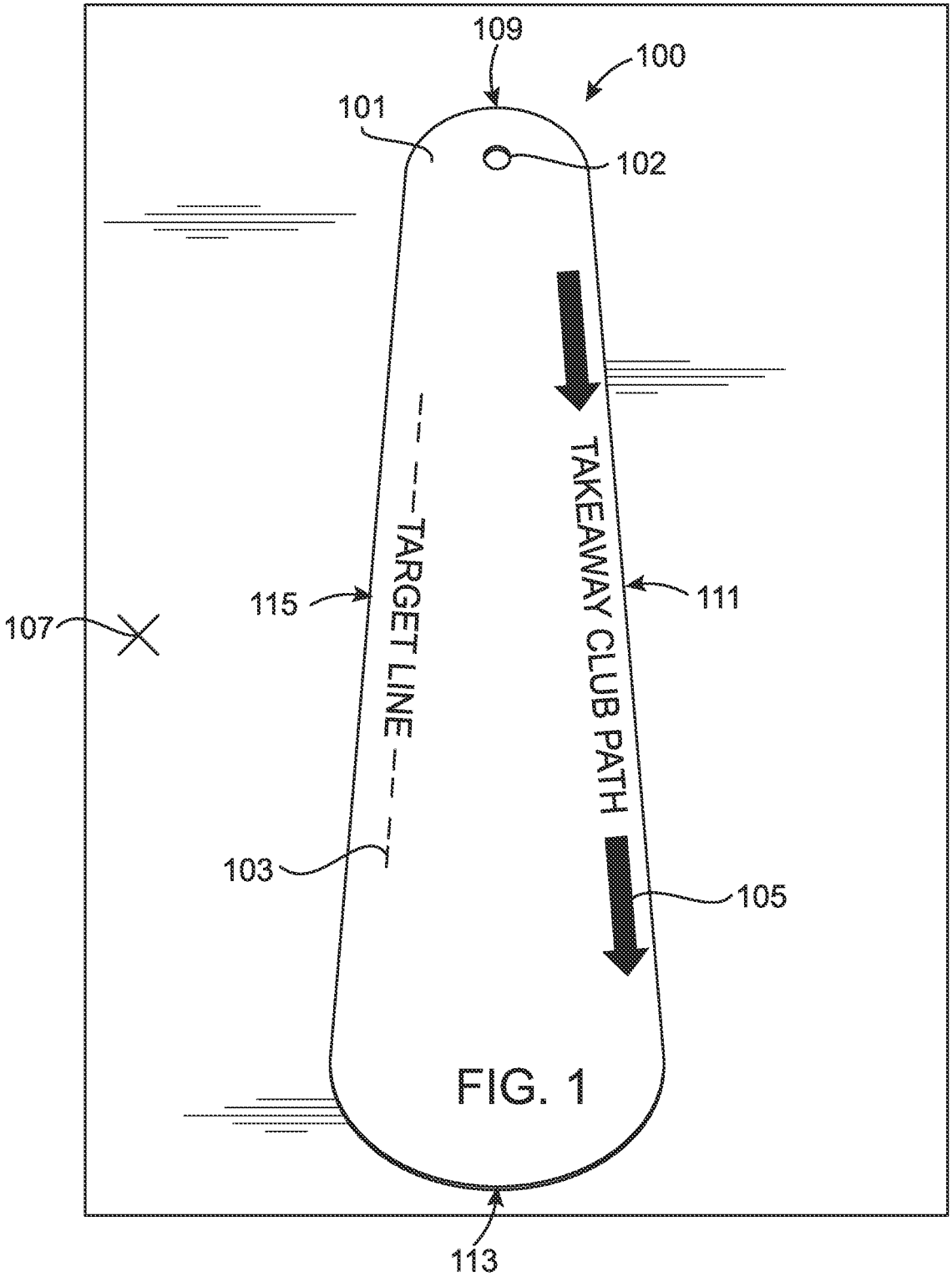
FIG. 4 depicts an embodiment of a golf swing training device in accordance with this application.
Figure 5:
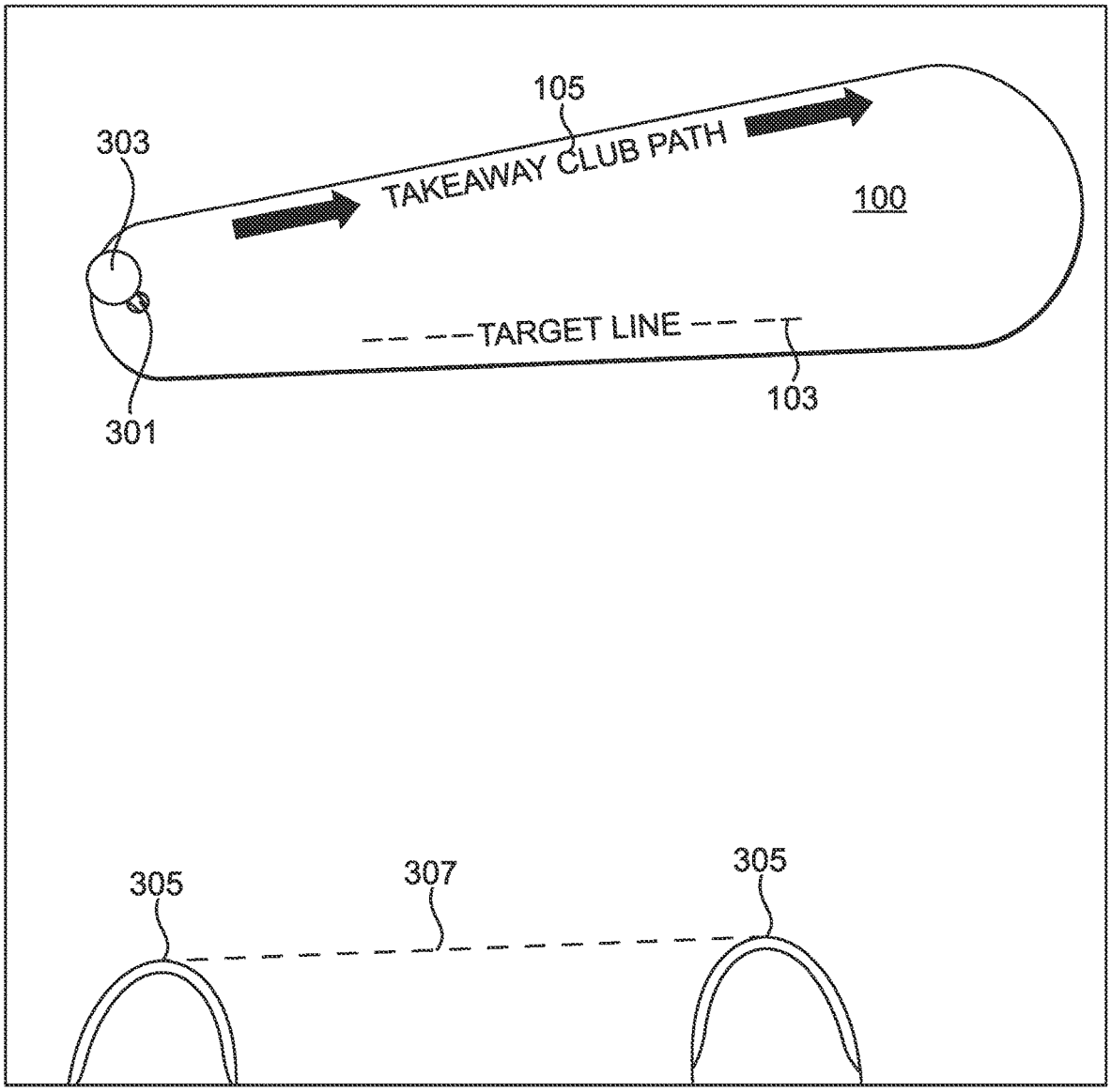
FIG. 5 depicts the training device of FIG. 4 positioned on a plastic training tee and with a ball present.

FIGS. 4 and 5 depict an embodiment of a golf swing training device (100). This golf swing training device (100) may assist with improving swing performance for a golfer. In particular, the golf swing training device (100) may assist a golfer with proper orientation of the golfer to the ball, as well as with proper alignment of the golfer's swing plane while taking a backswing.

The golf swing training device (100) includes a body (101). In an embodiment, the body (101) may be made from a plastic material, and may have a corrugated construction. In other embodiments, the body (101) may be made from plastic having a different construction. Overall, the body (101) may be made from any material having any orientation that is capable of assisting a golfer with obtaining a proper orientation to the ball and a proper backswing, as would be understood by persons of ordinary skill in the art.

Further, the body (101) in the embodiment depicted in FIGS. 4 and 5 is a continuous sheet of material having an orientation hole (102) for a typical golf tee or practice tee (301) although a ball (303) may be placed and held directly on the hole (102) in an alternative embodiment. FIG. 5 depicts the orientation hole (102) positioned over a plastic practice tee (301) of the type commonly found on a driving range. The tee (301) also has a ball (303) positioned thereon to better illustrate how the device (100) would be arranged by the golfer prior to using it to assist in hitting the ball (303).

The body (101) in the embodiment of FIGS. 4 and 5 is generally solid and of a generally "teardrop" shape with a rounded point. This is also commonly referred to as a "pear-shape". In other embodiments, the body (101) may be of a different shape and include any number of discontinuities or may be any shape or size. For example, the body may be triangular, rectangular, trapezoidal, or of any other shape and the body (101) may include one or more orientation holes (102) to accommodate a tee or a golf ball. These orientation holes (102) may be of any shape or size. Thus, the shape of the body (101) may be adjusted to accommodate any ball (303) and/or a tee (301) while maintaining the other features of the golf swing training device (100) discussed in detail below.

In the depicted embodiment, the body (101) has four sides: a first side (109) which, in this embodiment, is generally rounded or otherwise transcribes a smooth convex arc of some form; a second side (113) generally opposing to the first side (109) which, while longer than the first side (109) in this embodiment is also, in this embodiment, generally rounded and also transcribes a convex arc; a third side (111) between the first side (109) and the second side (113) which, in this embodiment, is generally linear; and a fourth side (115) that is between the first side (109) and the second side (113), as well as generally opposing to the third side (111), which in this embodiment is also generally linear.

This body (101) shown in FIGS. 4 and 5 provides for a convenient pear-shape that is suitable for placement of the angled indicators (103) and (105) without use of an excess of material, while also avoiding sharp corners to the device (100) which may be subject to breakage. As contemplated previously, this shape is by no means required and in other embodiments, the golf swing training device (100) may have more or less sides, the sides may transcribe a variety of lines and/or arcs, and/or the body (101) may be of other shapes. Further, each side may be generally straight, curved, or of another shape, as would be understood by a person of ordinary skill in the art.

The golf swing training device (100) has several features and indicators that are used to align the golfer and to ensure the golfer's backswing follows a proper plane. The first of these indicators is a target line indicator (103) and the second is a takeaway club path indicator (105). These indicators (103) and (105) are positioned relative to the orientation hole (102), discussed above, as these indicators relate to club path and desired hitting path relative to the ball (303) which is positioned at the orientation hole (102). More or less indicators may be used in other embodiments.

In the depicted embodiment, each of the target line indicator (103) and the takeaway club path indicator (105) are formed as generally straight lines. This will be true in most embodiments, at least because the orientation of these indicators, and their appearance to the golfer as lines, may allow the golfer to practice a proper backswing. In the depicted embodiment, the target line indicator (103) is manifested as a dashed line that is differentiated from the takeaway club path indicator (105) by the words "TARGET LINE," and its dashed nature all of which together form the semblance of a line. In other embodiments, any lines, symbols, shapes, or other indicators may be used, as long as those indicators visibly show the golfer the extent of the line or other target path to be indicated.

Further, in the depicted embodiment, the takeaway club path indicator (105) is manifested as two generally co-linear arrows, which arrowheads face the second side (113), and the words "TAKEAWAY CLUB PATH," all of which together form the semblance of a line or other path. In other embodiments, any lines, symbols, shapes, or other indicators may be used, as long as those indicators visibly show the golfer the extent of the line or path to be indicated or followed by the club.

In the golf swing training device (100), the target line indicator (103) and the takeaway club path indicator (105) generally form lines arranged at an angle between about 5 degrees and about 15 degrees. In the depicted embodiment, the lines created by the target line indicator (103) and the takeaway club path indicator (105) converge at an angle that is about 10 degrees. In some other embodiments, the lines created by the target line indicator (103) and the takeaway club path indicator (105) may converge at an angle that is about 8 degrees, about 9 degrees, about 11 degrees, or about 12 degrees. In the depicted embodiment, the first side (109) is about three feet apart from the second side (113), and accordingly, the body (101) is about three feet in length along its major axis. Further, the third side (111) is about 4 inches to about 8 inches apart from the fourth side (115) at the center of the body (101).

It should be recognized in the depicted embodiment that the lines of the takeaway path indicator (105) and the target line indicator (103) do not intersect the hole (102). This is partially due to the fact that the indicators (103) and (105) are generally intended to align with the club shaft (as opposed to specifically with the clubhead) and also to encourage the desired motion of the user during backswing where the club shaft and/or clubhead should not necessarily be aligned with the ball (300).

The relative orientation of the target line indicator (103) and the takeaway club path indicator (105) in the depicted embodiment is intended for right-handed golfers. In some embodiments, left-handed versions of the golf swing training device (100) are designed such that the target line indicator (103) and the takeaway club path indicator (105) are arranged on opposite sides from what is depicted in FIGS. 4 and 5. Alternatively, left-handed golfers may simply reverse the roles of the target line indicator (103) and the takeaway club path indicator (105) and address the device (100) from the opposing side of a golf swing training device (100) that is intended to be used by right-handed golfers.

Now a method of using the golf swing training device (100) will be described. This description generally utilizes the arrangement of FIG. 5 indicating how the device (100) has been positioned. In this method, a right-handed golfer would be practicing their swing using a selected club, which may be any club but generally not a putter. The device (100) is generally intended as a training aid and, as such, would typically not be used in an actual golf game. Instead it would be used to repeatedly practice repeatedly hitting balls with the same club.

First, a golfer would place the body (101) on the ground. Then the golfer may take one of three alternative actions. The first option is to position the body (101) first, and then add a tee and ball at the orientation hole (102). The second option is to place the tee first, then mount the body (101) over the tee using the orientation hole (102). The body (101) may then be oriented to the target. The third option is to omit the tee (301) and ball (303), allowing the golfer to practice their swing without actually contacting a ball (303). In this option, a tee (301) may still be used if desired.

In any case, the process for orienting the body (101) will typically be the same. The body's (101) positioning will be adjusted so that the target line indicator (103) points at and the first side (109) faces an imaginary or real target where the golfer would want to hit a ball (303) when taking a swing during the practice session. In particular, an extension of the line created by the target line indicator (103) should travel directly through the target point. The target may be anything visible to the golfer that is within a range of the golfer when using the club that will be swung during this practice session.

Alternatively, the golfer may not need to orient the body (101). Instead, the target line indicator (103) may merely show the golfer where the ball (303) would travel if hit while merely practicing their swing without a ball (303). Even if a ball (303) is used, the target line indicator (103) may serve to show the golfer that they have performed the recommended swing by confirming that the ball (303) actually did travel in the direction of the target line indicator (103) after being struck during the golfer's swing.

Next, the golfer places their feet (305) for the swing practice. Typically, a golfer will merely place their feet where they would normally when preparing for a golf swing and addressing a golf ball (303). In the depicted embodiment, the golf swing training device (100) may assist a golfer in performing a proper backswing, typically by altering the takeaway angle of the clubhead during the backswing. This may have the effects of opening up the golfer's swing and increasing the angle of the golfer's swing plane, which effects may improve the golfer's ability to make proper contact with the ball (303) using the clubface. For a right-handed golfer, the golfer's feet would typically be placed at or around the depicted marker (107) in FIG. 4 off the fourth side (115) and, in an embodiment, the body (101) may include structure to provide an indicator of foot placement. FIG. 5 illustrates a possible position of the feet (305), but this may be further away than actually desired unless a very long club (such as a driver) is being swung.

The golfer's feet (305) would be placed beyond the body (101) on the same side of the body (101) as the fourth side (115). Further, the golfer would typically line up their feet (305) so that the line that extends from the tip of their right foot through the tip of their left foot also is directed at the target. That is the line (307) connecting the tips of their feet (305) is generally parallel to the target line (103). Once properly oriented, the golfer would practice their full golf swing, being sure to keep the clubhead above the line created by the takeaway club path indicator (105) during the initial portion of their backswing. The golfer may then continue with their downswing and follow though after correctly performing their backswing as indicated just above.

Their downswing path will typically track generally along the target line (103) if the swing is performed correctly and will not track the takeaway club path (105). It should be recognized that most people typically can align the clubhead of the club to the ball (303) during the downswing so long as they are looking at the ball (303) during the downswing. Moving the club along the takeaway path indicator (105) may produce a motion that is not what the user expects when originally addressing the ball. This is particularly true because if the club was sung along the takeaway path line (105) it would be expected to miss the ball (303) completely. However, if the user tracks the club along the line (105) as they initiate their backswing, they should be more likely to coil the body correctly during the backswing to bring the club on the downswing along the target line (103) and into the ball (303). During the downswing, their fairly natural adjustments to body position to bring the club into contact with the ball (303) can serve to better orient their body and downswing to the positons of FIGS. 1 and 3.

Repeating the swing motion with the device (100) may assist a golfer with properly setting up their swing with a proper backswing and create muscle memory of how to move the club to hit the ball (303) generally along the target line (103). Further, the immediate feedback of seeing the ball (303) travel along the path indicated by the target line (103) can encourage the golfer that they are doing the motion correctly stimulating increased practice. In some embodiments, the golfer may actually hit the ball while practicing their swing to verify that the ball is proceeding generally to the target point oriented to the target line (103). Video may also be used by the golfer to watch elements of their swing allowing them to repeatedly see the motion of the club relative to the device (100) in both backswing and downswing.

While the invention has been disclosed in conjunction with a description of certain embodiments, including those that are currently believed to be useful embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

The qualifier "generally," and similar qualifiers as used in the present case, would be understood by one of ordinary skill in the art to accommodate recognizable attempts to conform a device to the qualified term, which may nevertheless fall short of doing so. This is because terms such as "straight" are purely geometric constructs and no real-world component or relationship is truly "straight" in the geometric sense. Variations from geometric and mathematical descriptions are unavoidable due to, among other things, manufacturing tolerances resulting in shape variations, defects and imperfections, non-uniform thermal expansion, and natural wear. Moreover, there exists for every object a level of magnification at which geometric and mathematical descriptors fail due to the nature of matter. As a simply example, one typically considers a sheet of paper or a piece of cardboard to be of generally planar construction even through such items are clearly 3-dimensional constructs and the strict mathematical definition of "planar" only applies to a 2-dimensional abstraction impossible to obtain in the real world. One of ordinary skill would thus understand the term "generally" and relationships contemplated herein regardless of the inclusion of such qualifiers to include a range of variations from the literal geometric meaning of the term in view of these and other considerations.

The invention claimed is:

1. A method for practicing a golf swing, the method comprising:

providing a training device comprising:

a generally planar body having a hole arranged therein;

a first indicator shown on said body, said first indicator indicating a target line which does not intersect with said hole; and a second indicator shown on said body, said second indicator indicating a takeaway club path line which does not intersect with said hole;

wherein said target line and said takeaway club path line have an angle between them of about 5 to about 15 degrees;

placing a golf ball on a tee in said hole;

aligning said training device so said target line indicates a desired path to project the golf ball;

moving a golf club through a backswing, said backswing directing said club generally along said takeaway club path line; and moving said golf club through a downswing, said downswing directing said club generally along said target line and contacting said ball.

2. The method of claim 1 wherein said body is generally pear-shaped.

3. The method of claim 2 wherein said body includes two generally linear sides or generally equal length and two generally arcuate sides, a first of said two generally arcuate sides being longer than a second of said two generally arcuate sides.

4. The method of claim 3 wherein said two generally arcuate sides are about 3 feet apart.

5. The method of claim 3 wherein said two generally arcuate sides transcribe convex arcs.

6. The method of claim 1 wherein said angle between said target line and said takeaway club path line is about 8 to about 12 degrees.

7. The method of claim 6 wherein said angle between said target line and said takeaway club path line is about 9 to about 11 degrees.

8. The method of claim 1 wherein said angle between said target line and said takeaway club path line is about 10 degrees.

9. The method of claim 1, further comprising:

standing beside said training device closer to said target line than said takeaway club path line.

10. The method of claim 1, further comprising:

lining up a golfer's feet so that a line that extends from the tip of a right foot through the tip of a left foot is generally parallel to the target line.

* * * * *